United States Patent [19]

Classon

[11] 4,272,642

[45] Jun. 9, 1981

[54] GAS-INSULATED HIGH-VOLTAGE BUSHING WITH SHIELD ELECTRODE EMBEDDED IN AN ANNULAR INSULATING BODY

[75] Inventor: Ake Classon, Ludvika, Sweden

[73] Assignee: ASEA Aktiebolag, Vasteras, Sweden

[21] Appl. No.: 74,236

[22] Filed: Sep. 10, 1979

[30] Foreign Application Priority Data

Sep. 13, 1978 [SE] Sweden ..... 7809619

[51] Int. Cl.[3] ..... H01B 17/26; H01B 17/42

[52] U.S. Cl. ..... 174/31 R; 174/142

[58] Field of Search ..... 174/31 R, 73 R, 73 SC, 174/142

[56] References Cited

U.S. PATENT DOCUMENTS

| | | | |
|---|---|---|---|
| 1,752,281 | 3/1930 | Austin | 174/142 |
| 2,146,069 | 2/1939 | Higgins | 174/142 X |
| 2,967,901 | 1/1961 | Priaroggia | 174/73 R |
| 3,934,071 | 1/1976 | Tahiliani | 174/142 X |

FOREIGN PATENT DOCUMENTS

| | | | |
|---|---|---|---|
| 2340899 | 2/1975 | Fed. Rep. of Germany | 174/142 |
| 409041 | 9/1966 | Switzerland . | |
| 596646 | 3/1978 | Switzerland . | |

*Primary Examiner*—Laramie E. Askin

[57] ABSTRACT

An electrical bushing which contains a pressurized gas as the main insulation and which contains a metallic shield electrode therein near the grounded end of the tubular outer insulator for control of the voltage distribution, also includes a solid insulating body which is made of a material having a higher permittivity than the insulating gas, thus enabling the bushing to have a smaller diameter. The metallic shield electrode is at least partially embedded in the insulating body. The insulating body includes an upper field-controlling portion in the space between the tubular outer insulator and the central current conductor which includes an inner side that extends towards the conductor to form a tapered annular space, most of the upper portion being located beyond the metallic shield electrode with respect to the grounded end of the tubular insulator.

10 Claims, 4 Drawing Figures

Shield Electrode
100%
80
60
40
20
0
1
2
3
4
5
6
7
8
9
10
11
12
13

GAS-INSULATED HIGH-VOLTAGE BUSHING WITH SHIELD ELECTRODE EMBEDDED IN AN ANNULAR INSULATING BODY

BACKGROUND OF THE INVENTION

1. Field of the Invention

The present invention relates to a high-voltage electrical bushing useful with metal-enclosed, pressure-gas insulated switchgear.

2. The Prior Art

Bushings which are used for connecting gas-insulated apparatuses and plants to overhead electrical lines usually comprise an outer ceramic insulator which is in surrounding relationship to the central conductor, and the space between the conductor and the inside of the insulator is filled with a pressurized gas, for example $SF_6$. Such bushings also include metal flanges at opposite ends of the insulator, with one of the flanges being directly connected to the current conductor in the bushing (to thus have the same electrical potential as the conductor), the second flange being in non-contacting relationship to the conductor (to thus be at a ground potential). The second flange usually supports at least one shield electrode made of an electrically-conductive material which functions to control the voltage distribution in a radial direction inside the grounded end of the insulator, as well as in the axial direction along the outer side of the insulator. The shield electrode has its top end located a short distance up within the lower end of the insulator, and it is often supplemented with one or more shield rings located on the outer side of the insulator.

In order to maintain the electric field strength at an acceptably low level, the shield electrode has to be formed with a large internal diameter and with a large edge radius at its upper end. This requires an insulator which has a large internal base diameter; however, use of large internal base diameters results in great mechanical stresses because of the pressure created by the enclosed pressurized insulating gas. In addition, a large diameter of the insulator makes it more difficult to provide a gas-tight attachment of the insulator to other structures.

In addition to the foregoing, in order that the top part of the insulator and its metal flange have acceptable dimensions, the insulator is normally made markedly conical, which, however, makes an efficient production thereof difficult.

For the foregoing reasons, bushings of conventional design are relatively expensive.

An object of the present invention is to provide a gas-insulated high-voltage bushing which has a smaller diameter and is cheaper to manufacture than comparable bushings of conventional design.

SUMMARY OF THE INVENTION

According to the present invention, the gas insulation within the outer insulator is augmented with a solid insulating body which is at least partly in surrounding relationship to the grounded shield electrode and which is formed with a special shape and to have a considerable volume above the shield electrode within the bushing. The shield electrode can thus have very moderate dimension and the outer insulator portion of the bushing, and thus the bushing itself, can be made with a very moderate diameter.

In accordance with the invention the voltage distribution within the bushing is controlled by the use of the solid insulating body due to the fact that it is made of a material which has a much higher permittivity ($\epsilon$) than that of the insulating gas. For example, the material may be an epoxy resin which will have a relative permittivity of 4 or more. Furthermore, the voltage distribution is also controlled by the exact shape the insulating body has, the insulating body preferably having an inner field-controlling surface which creates an upwardly tapering insulating gas-containing cavity.

In another embodiment of the invention the bushing diameter can be reduced even further if the diameter of the current conductor nearest the insulating body is reduced and then coated with a field-equalizing insulating layer.

In a further embodiment of the invention sealing members are positioned between the current conductor and the upper end of the insulating body, such that the internal space within the bushing is divided into two gas spaces separated from each other. In this way, the ceramic outer insulator will not be subjected to the same high insulating gas pressure which necessarily prevails in that portion of the bushing which has to be dimensioned for high field strengths, which gas pressure also prevails in the rest of the switchgear enclosure.

The features of the present invention will be better understood by reference to the accompanying drawings and the following description.

DETAILED DESCRIPTION OF THE PREFERRED EMBODIMENT

Figures 1, 2, 3, 4:
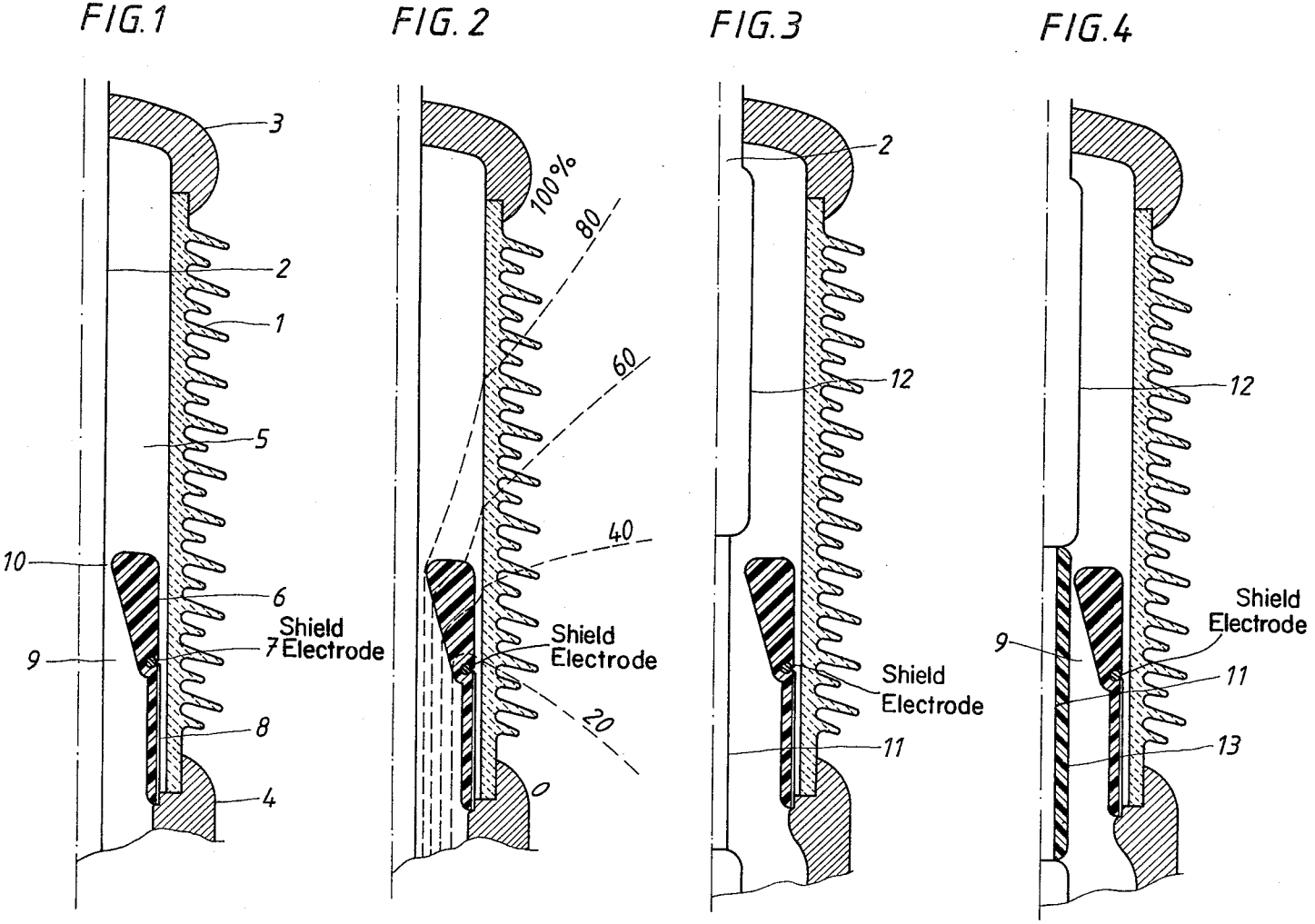
FIG. 1 shows a partial cross-sectional view of a bushing constructed in accordance with the present invention.
FIG. 2 depicts the approximate voltage distribution in and around a bushing made in accordance with FIG. 1.
FIGS. 3, 4 and 5 show partial cross-sectional views of alternate bushing constructions in accordance with the present invention.

The inventive bushings, various embodiments of which are depicted in FIGS. 1, 3 and 4, are primarily intended for use with metal-enclosed gas-insulated switchgear. The bushings include an outer elongated tubular ceramic insulator 1 and a central through-conductor 2. Metal flanges 3 and 4 are attached to opposite respective ends of the insulator 1, with seals (not shown) arranged between the flanges and the insulator. The insulator 1 is hollow and has a cylindrical inner wall. The upper flange 3 is formed so as to be in direct electrical contact with the conductor 2 and thus is at a high electrical potential, whereas the lower flange 4 is shaped so as not to be in contact with the conductor 2 and thus is at ground potential, i.e., since it is simply screwed onto the enclosure of the switchgear. The space 5 between the conductor 2 and the insulator 1 is filled with an insulating gas under pressure, for example, $SF_6$ at 0.45 MPa.

An insulating body 6 is supported to be located in space 5 by the metal flange 4, and it is formed to at least partially enclose the upper rounded edge of an electrically conducting shield 7. The body 6 is composed of, for example, an epoxy resin which has a high permittivity relative to that of the insulating gas in the space 5. The shield 7 may consist of, for example, a copper wire coil which is appropriately cast within the insulating body, and it is connected to the grounded lower metal flange 4 via a cylindrical portion 8, which itself consists of either a conductive coating on the outer side of the insulating body 6 or a metal net appropriately cast into the insulating body.

Due to the high permittivity of the insulating body 6, the shield 7 may be made with a considerably smaller edge radius than a corresponding shield which is placed directly in the insulating gas, and the surrounding insulator 1 may be formed with a considerably smaller inner diameter.

In more detail, and as can be seen from FIG. 1, the insulating body 6 comprises a lower, hollow cylindrical portion 8 which supports on lower metal flange 4 an upper field-controlling portion which on its outer side forms a cylindrical surface, whereas on its inner side comprises a surface which extends towards the central conductor 2, thereby producing a conically upwardly tapering insulating gas-containing cavity 9 within space 5. A relatively narrow gas gap 10 is left at the point where the inner side of the upper field-controlling portion of body 6 curves outwardly towards the outer side thereof via a generally flat top surface. The included angle between the two intersections between the inner side surface and a plane through the center line of the bushing being about 10° to 90°, and preferably between about 20° and 60°.

With the embodiment of the inventive insulating body shown in FIG. 1, the electrical field in the gas around the conductor 2 near the lower, hollow cylindrical portion 8 is controlled such that the equipotential surfaces form concentric cylinders around the conductor, but at the point where these surfaces meet the inner side wall of the insulating body (which of course has a high permittivity), the equipotential surfaces are deflected outwardly as shown in FIG. 2. In FIG. 2 the numerals shown denote the potentials in percentages.

By a suitable choice of both the relative permittivities of the insulating gas and the material forming the insulating body 6, and the shape of the insulating body 6, the electric field can be controlled such that the voltage is distributed satisfactorily evenly, both internally within the bushing and in the axial direction along the outer side of the insulator. Critical voltage concentrations in the air outside the flange and the shield can be avoided. In this way the insulator 1 may be optimally dimensioned both with regard to its length and its diameter. The resulting moderate base diameter in many cases permits the insulator to be constructed with a favorable cylindrical shape. The need for the use of supplementary external shield rings is also completely eliminated.

The field strength in the gas adjacent the conductor 2 within the tapering cavity 9 controls the diameter, and thus the cost, of the bushing. As indicated in FIG. 2, the field strength in the bushing diminishes rapidly in a radial direction at points above the insulating body 6. This characteristic is utilized in the embodiment of the invention shown in FIG. 3.

In FIG. 3 a thick conductor 2 which has a high current-carrying capacity is formed to include a thinner portion 11 located along the portion of the conductor adjacent cavity 9 which determines the necessary diameter of the bushing. Because portion 11 is short relative to the total length of the conductor, any increase in temperature in this thinner portion may be compensated for by use of an increased diameter portion 12 located above portion 11. The increased dimension of portion 12 does not itself, however, affect the overall external dimensions of the bushing.

With the design shown in FIG. 4 the diameter of the insulator 1 can be even further reduced by providing the conductor 2 along its portion adjacent the cavity 9 with a solid insulation 13 of a material having a higher permittivity than that of the insulating gas. This insulation may advantageously consist of a shrunk-on sleeve of, for example, cross-linked polyethylene (PEX), formed on the conductor using the technique used in the construction of PEX cables. On its inner side the sleeve has a layer of conductive PEX which, in combination with the rounded edges of the conductor 2 facing the thinner PEX-coated portion, eliminates the risk of partial discharges.

The insulator and thus the bushing according to FIG. 4 may have reduced diameters because the thin conductor with the PEX insulation discharges the field strength of the gas layer nearest the PEX insulation such that the needed radial gas area can be reduced.

Figure 5:
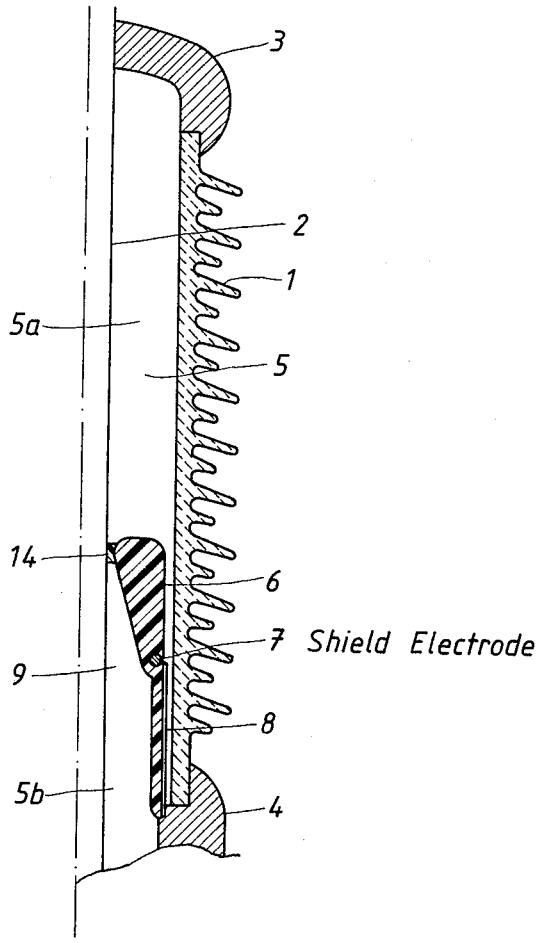

In a further embodiment of the invention a sealing device 14 as shown in FIG. 5 can be positioned between the upper inner side of the insulating body 6 and the current conductor 2. The sealing device will act to, in effect, divide the space 5 within the ceramic insulator 1 into upper and lower zones **5*a* and 5*b***. The pressurized insulating as can be, in this embodiment, confined to the lower zone, and thus the inside of the ceramic insulator need not be subjected to the high pressures that would otherwise be the case.

While there has been shown and described various preferred embodiments of the present invention, it is obvious that various changes and modifications can be made therein and still be within the scope of the invention as defined in the appended claims.

I claim:

1. In an electrical high-voltage bushing for a metal-enclosed, pressure gas insulated switchgear, which bushing includes an elongated hollow tubular insulator, a centrally located current conductor, the space between the conductor and the inner surface of the tubular insulator being filled with a pressurized insulating gas, the bushing further including a metal flange connected to one of the ends of the tubular insulator for connecting the bushing to a bushing opening in the ground metal enclosure of a switchgear, and an annular shield electrode positioned within the space between the conductor and the inner surface of the tubular insulator near the metal flange, the shield electrode being electrically connected to the metal flange, the improvement wherein an annular insulating body is positioned in said space between the conductor and the inner surface of the tubular insulator near the metal flange, said shield electrode being at least partially embedded within said annular insulating body, said annular insulating body being composed of a material which displays a permittivity several times higher than the permittivity of the insulating gas within said space, said annular insulating body being connected to said metal flange and extending away therefrom a distance further than the distance between said shield electrode and said metal flange, the volume of said annular insulating body located beyond said shield electrode with respect to said metal flange being several times greater than that of said shield electrode, said annular insulating body including a field-controlling upper portion remote from said metal flange which includes an inner side which extends towards said central current conductor so as to form a tapering annular space between said current conductor and said field-controlling upper portion in a direction away from said metal flange.

2. The bushing according to claim 1 wherein said shield electrode comprises a copper wire coil.

3. The bushing according to claim 1 wherein the inside wall of said elongated hollow tubular insulator is cylindrical.

4. The bushing according to claim 1 wherein said insulating body includes an annular lower portion connecting said field-controlling upper portion with said metal flange, said annular shield electrode being at least partially embedded in said field-controlling upper portion near its connection point with said annular lower portion.

5. The bushing according to claim 1 wherein said annular insulating body has an outer surface which is substantially cylindrical.

6. The bushing according to claim 1 wherein the intersections between the inner surface of said field-controlling upper portion and a plane through the center of said tubular insulator defines an angle of between about 20° and 60°.

7. The bushing according to claim 1 wherein said insulating body is composed of an epoxy resin.

8. In an electrical high-voltage bushing for a metal-enclosed, pressure gas insulated switchgear, which bushing includes an elongated hollow tubular insulator, a centrally located current conductor, the space between the conductor and the inner surface of the tubular insulator being filled with a pressurized insulating gas, the bushing further including a metal flange connected to one of the ends of the tubular insulator for connecting the bushing to a bushing opening in the ground metal enclosure of a switchgear, and an annular shield electrode positioned within the space between the conductor and the inner surface of the tubular insulator near the metal flange, the shield electrode being electrically connected to the metal flange, the improvement wherein an annular insulating body is positioned in said space between the conductor and the inner surface of the tubular insulator near the metal flange, said shield electrode being at least partially embedded within said annular insulating body, said annular insulating body being composed of a material which displays a permittivity several times higher than the permittivity of the insulating gas within said space, said annular insulating body being connected to said metal flange and extending away therefrom a distance further than the distance between said shield electrode and said metal flange, the volume of said annular insulating body located beyond said shield electrode with respect to said metal flange being several times greater than that of said shield electrode; and wherein said central conductor has a smaller diameter along the length thereof corresponding substantially to the distance the insulating body extends away from the metal flange than the remainder of said central conductor within said tubular insulator.

9. The bushing according to claim 8 wherein said portion of said central conductor which has a reduced diameter is coated with an insulating layer.

10. In an electrical high-voltage bushing for a metal-enclosed, pressure gas insulated switchgear, which bushing includes an elongated hollow tubular insulator, a centrally located current conductor, the space between the conductor and the inner surface of the tubular insulator being filled with a pressurized insulating gas, the bushing further including a metal flange connected to one of the ends of the tubular insulator for connecting the bushing to a bushing opening in the ground metal enclosure of a switchgear, and an annular shield electrode positioned within the space between the conductor and the inner surface of the tubular insulator near the metal flange, the shield electrode being electrically connected to the metal flange, the improvement wherein an annular insulating body is positioned in said space between the conductor and the inner surface of the tubular insulator near the metal flange, said shield electrode being at least partially embedded within said annular insulating body, said annular insulating body being composed of a material which displays a permittivity several times higher than the permittivity of the insulating gas within said space, said annular insulating body being connected to said metal flange and extending away therefrom a distance further than the distance between said shield electrode and said metal flange, the volume of said annular insulating body located beyond said shield electrode with respect to said metal flange being several times greater than that of said shield electrode; and wherein a sealing means is positioned between the central conductor and the insulating body to divide the space between the central conductor and the tubular insulator into two separate gas-containing zones.

* * * * *